US008944974B2

(12) United States Patent
Foster

(10) Patent No.: US 8,944,974 B2
(45) Date of Patent: Feb. 3, 2015

(54) RESTRICTION COMPRESSION WEIGHTED THERAPY SUIT

(76) Inventor: James J. Foster, Simi Valley, CA (US)

( * ) Notice: Subject to any disclaimer, the term of this patent is extended or adjusted under 35 U.S.C. 154(b) by 269 days.

(21) Appl. No.: 13/549,461

(22) Filed: Jul. 14, 2012

(65) Prior Publication Data

US 2013/0017933 A1 Jan. 17, 2013

Related U.S. Application Data

(60) Provisional application No. 61/508,056, filed on Jul. 14, 2011.

(51) Int. Cl.

| | |
|---|---|
| ***A63B 21/00*** | (2006.01) |
| ***A41D 13/00*** | (2006.01) |
| ***A63B 21/05*** | (2006.01) |
| ***A63B 21/065*** | (2006.01) |
| ***A63B 23/035*** | (2006.01) |

(52) U.S. Cl.

CPC ..... *A41D 13/0015* (2013.01); *A63B 21/05* (2013.01); *A63B 21/065* (2013.01); *A63B 21/1415* (2013.01); *A63B 21/1423* (2013.01); *A63B 21/1434* (2013.01); *A63B 23/03575* (2013.01); *A63B 21/00065* (2013.01); *A63B 21/00069* (2013.01); *A63B 2208/0204* (2013.01); *A63B 2209/10* (2013.01); *A63B 2225/09* (2013.01)

USPC ..... 482/124; 482/69; 482/227; 482/238

(58) Field of Classification Search

USPC ..... 2/69, 227, 79, 239, 228, 238; 482/124

See application file for complete search history.

(56) References Cited

U.S. PATENT DOCUMENTS

| | | | | |
|---|---|---|---|---|
| 3,759,510 | A * | 9/1973 | Jackson, Jr. | 482/105 |
| 2007/0219074 | A1 * | 9/2007 | Pride | 482/124 |

* cited by examiner

*Primary Examiner* — Jerome W Donnelly

(74) *Attorney, Agent, or Firm* — Gary L. Eastman, Esq.

(57) ABSTRACT

A motion resistance suit provides adjustable musculoskeletal compression and increasing resistance over a user's full range of motion. The suit provides increasing resistance over the range of user movements through the use of a porous elastic material that allows for the body to dissipate heat and perspiration. The suit utilizes pockets located in strategic areas for the addition of weights, thereby controlling the amount of resistance felt during use. The pockets are located to allow full range of motion. Cinches are used to control the amount of compression and to create a snug fit which minimizes unwanted movement of the suit and weights. The suit consists of a shirt portion, detachable sleeves, a pants portion, and detachable pant extensions. The user is able to quickly and easily change the amount of weight and the amount of compression based on the exercises being performed and the desired effect.

19 Claims, 6 Drawing Sheets

RESTRICTION COMPRESSION WEIGHTED THERAPY SUIT

RELATED APPLICATIONS

This application claims the benefit of priority from U.S. Provisional Patent Application Ser. No. 61/508,056, filed by this inventor on Jul. 14, 2011, and fully incorporated herein by this reference.

FIELD OF THE INVENTION

The present invention relates generally to the field of garments, and more particularly to an athletic garment, made of an elastic material with integral pockets. The garment is designed to cover specific areas of the body and provide a continuous minimum amount of resistance to movement with increasing resistance as body muscles move from the relaxed position to the contracted position. The pockets of the garment can be filled with varying amounts of weight to control the amount of resistance applied to muscles during movement. This type of garment can leave users more able to do a variety of movements, including athletics, exercises, and manual labor.

BACKGROUND

Resistance strength training is a proven and effective method to increase overall health, facilitate weight loss, prevent and rehabilitate motion related injuries, as well as improve strength, coordination, balance, and reaction time. The goal of resistance training is to gradually and progressively load the musculoskeletal system so as to cause muscles to respond by increasing density and mass. The object of resistance training is to use an "elastic" force, similar to a rubber band, to apply an increasing resistance to muscles as they move from the relaxed position to the fully contracted position, as well as "gravity" force. Since each individual has a unique and personal pattern of movement (Biomechanical DNA), it is critical that the resistance applied allows each individual to realize the highest percentage of his or her genetic capability without altering the body's normal biomechanics. The "elastic" force is different from "gravity" force, which is typical in exercises using free weights, in that "gravity" force is constant and does not change with the position of the muscle or weight. In addition to the increased effect of gravity on the person, it also adds resistance to ballistic type movements, i.e. rapid starts and stops, due to more force needed to overcome the inertia of heavier masses. It creates the need for greater deceleration effort at the end of a move due to the increased momentum resulting from the movement of a heavier mass.

Until now, the strength of actual specific movements, such as throwing or kicking a ball, was thought to be increased by performing unrelated resistance movement like a bench press or a weighted squat. Athletes and patients were taught to practice their techniques, such as running, walking, and throwing, by using the unrelated movements to increase their strength. As it turns out, this is neither the best nor the most efficient way to achieve maximum strength. The best and most efficient way to achieve maximum strength is to perform any particular movement or set of movements naturally with full range of motion against progressive resistance. Strength and technique are not trained individually, but are trained as one to achieve maximum effectiveness. This relates to the concept of "Specificity of Training". This concept implies that conditioning mirrors, to as great an extent as possible, the movements that occur or are expected to occur in a competitive event or rehabilitation program. Absolute specificity is difficult to achieve and requires critical musculature to be activated at specific speeds, joint angles, and under the metabolic conditions present in competition or rehabilitation. Through the use of resistance strength training, an athlete or patient can come as close as possible to achieving absolute specificity.

A component of resistance strength training is Proprioceptive Neuromuscular Facilitation (PNF). PNF was developed in the 1940s and 1950s to rehabilitate patients with paralysis. Since that time, the use of PNF has expanded to include recovery from physical injuries and the training of athletes. PNF combines elements of stretching and contractions of muscles. The movements stimulate the golgi tendon and muscle spindles which result in impulses being sent to the brain. In turn, the brain sends signals back to the muscles causing them to contract and relax. Since PNF is applied over the complete range of muscle motion, it encourages greater flexibility, coordination, reaction time, joint stability, and overall muscle development. The main advantages of PNF are increased biomechanics, reduction in muscle fatigue, and help in preventing injuries associated with overuse. Physical therapists, chiropractors, athletic trainers, and other medical professionals currently use PNF.

Another factor that contributes to enhanced training is muscle compression. The most common form of muscle compression is the use of a compression garment such as stockings. Medical compression stockings have been used in the treatment of poor venous blood flow and other post-surgical conditions for more than 50 years. These stockings create a controlled and graduated compressive force on the leg, where the highest compression is at the point furthest from center body mass and decreasing compression moving toward center body mass. In recent years, this concept has been adapted for use by athletes during and after training. The benefits of using compression garments are enhanced lactate removal during and after exercise, reduced muscle oscillations resulting from rapid starts and stops, increased endurance, decreased levels of Creatine Kinase, and reduced symptoms of Delayed Onset Muscle Soreness.

There have been several athletic garments heretofore made which have used various techniques to implement a resistance suit. Some implementations are as simple as a sleeveless vest of fixed weight, with other implementations consisting of sleeved vests and pants, both of which can have weight added or removed to control the amount of resistance. The materials used range from a non-breathable neoprene to a mesh Lycra that allows ventilation to reduce body heat and perspiration. Various methods of securing the suit to the body are also used, ranging from hook and loop fasteners, such as Velcro straps, to zippers.

SUMMARY OF THE. INVENTION

Briefly, the invention is an athletic garment that is fabricated from a breathable elastic material such as Lycra. At strategic locations located on the garment, pockets are attached which allow for the addition of weights. The location of the pockets allow for body movements to feel the full resistance of the weight while not interfering or impeding range of motion. The pockets are designed to keep the weights snug against the body to prevent unwanted movement during body motion. The use of Lycra allows for the gradual increase in resistance as the material stretches with user movements.

The Restriction Compression Weighted Therapy Suit of the present invention consists of a shirt with detachable sleeves and pants with detachable leg extensions. The shirt has a front portion that covers the majority of the lower torso and the general upper chest area. Above the chest area are shoulder straps that go over the shoulders and connect to the rear portion. The back section covers the back area from the lower back up to the neckline and to the outsides of the shoulder blades. The lower back portion wraps around the sides of the torso and connects to the front portion. The front portion contains a zipper that runs vertically from the bottom of the shirt to the top and facilitates the ease with which the shirt may be put on and taken off. At strategic points located on the shirt are integral pockets with a flap that is secured closed using a hook and loop type system, such as Velcro, buttons, snaps, or zippers. The pockets are designed to snuggly hold weights of varying types, ranging from cylinders to flattened bars. Weights may be added or removed depending on the level of resistance desired by the user.

The shirt is manufactured from Lycra. Lycra is an elastic material that will stretch to conform to the surface to which it is applied. As a result, the Lycra will provide a compression to the body in the areas to which it is applied. The amount of pressure applied is adjustable and can vary due to varying sizes of the human body. To support these variances, a series of Velcro cinches are used at strategic points on the shirt. After the user puts on the shirt, the Velcro cinches are used to adjust the tightness of the suit therefore controlling the amount of compression felt by the muscles. As time progresses with use of the suit, the shape of the user's body may change such that adjustments will need to be made to maintain proper compression and fit. The use of Velcro cinches allows for quick and easy adjustment. In situations where the suit will be used by more than one person, the cinches will allow for the fit of the suit to quickly and easily be adjusted to accommodate the needs of the current user.

Along the outside edges of the shoulder panels, heavy duty zippers are attached. The zippers allow for sleeves to be attached to the shirt. It is to be appreciated that other methods of attachment, such as buttons and snaps, are fully contemplated. The use of removable sleeves allows for a tailored amount of resistance to be supplied by the suit based on the type of exercise to be performed and the specific needs of the user. The sleeves are constructed of the same elastic material as the vest and provide the same compression effects. The sleeves have a top portion that connects to the vest in the area above the shoulder. The front, back, and underarm areas are open to allow for the free movement of the arm. The sleeve encircles the arm starting at the top of the bicep and extends to the mid-forearm. Pockets are located along the sides of the arm to allow for the addition of weights. The pockets and open areas are specifically located to allow the arm to achieve full range of motion. Cinches are located in the middle of the upper arm and the middle of the forearm. The cinches can be easily adjusted to control the amount of compression felt by the arm muscles.

Pants are used to provide resistance during lower body and leg exercises. The pants are manufactured from Lycra and provide the same breathability as the vest and sleeves. The pants utilize a Velcro belt that is snuggly secured around the user's waist. The belt can easily be adjusted as the user's body shape changes or to fit different users. The pants have a front portion that extends from the waist belt to the mid-thigh. To ensure full range of motion, the back of the pants are open, which includes the buttocks, groin areas, and the area along the back of the legs. The pants have a cinch located at mid-thigh to control the compression felt by the thigh muscles. Pockets are located on the front of the pants and are located so as not to impede range of motion.

Along the bottom edge of the pants are heavy duty zippers. Pant leg extensions can be attached to increase the resistance felt by the legs during exercise. The addition of the extensions also allows for the resistance to be better distributed along the length of the leg so as to provide more effective and comfortable motions by the user. The extensions are manufactured Lycra and provide the same compression and resistance effects as the shirt, sleeves, and pants. The extensions have a heavy-duty zipper attached along its top that allows them to be easily added or removed based on the exercise needs of the user. The pant extensions extend past the knee and go to the mid-calf. Similar to the pants, the pant extensions only cover the front of the leg, leaving the back and the leg and knee free to allow for full range of motion. Pockets are located on the front of the pant extensions to allow for the quick and easy addition or removal of weights. The pant extension has a cinch located at the bottom to allow for adjustable compression to be applied to the calf.

From the moment the suit is put on, the nervous system starts to become programmed by sending impulses to the muscles telling them to "work harder". When the suit is removed, even though the brain knows that the resistance is gone, the programmed nervous system continues to send the "work harder" impulses to the muscles. The results are the same as if one went to lift a heavy box or suitcase, where the muscles would be programmed to "explode" to meet the resistance. If in fact the box or suitcase was empty, the muscle explosion would cause it to feel even lighter and it would move very quickly as compared to moving it while knowing that it is actually empty.

The present invention is designed to allow the user to choose the amount of resistance and the amount of compression to be used during exercise, and to provide the user with a quick and easy method for adjusting the resistance and the compression so as not to interfere with the exercise routine. The shirt may be used by itself, or one may include the use of the sleeves. Similarly, only the pants may be used, or one may choose to include the pant extensions. For an exercise routine that targets the upper and lower portions of the body, a user may choose to use the shirt, sleeves, pants, and pant extensions. The resistance suit can be used during sports training to decrease the amount of time required to perform warm-up exercises, and to acclimate muscle motion and response to a high level of resistance. When the suit is removed, the sudden decrease in resistance will be have the effect of quicker reaction times, more fluid movements, and an increased range of motion.

In an alternative embodiment of the present invention, the Therapy Suit consists of two distinct and separate portions, an upper portion and a lower portion. The upper portion covers the torso, shoulders, and arms. The lower portion covers the waist, hips, and legs. The suit is made from a stretchable and breathable material, such as Spandex, which allows the suit to conform to the user's body without the use of cinch straps, which allows for an even more free and natural range of motion. Both portions of the suit have pockets that allow for the quick addition or removal of weights. Additionally, since the suit material closely conforms to the body of the user, the suit is designed without the need for cutouts in areas such as the underarm area of the upper portion and behind the knee area of the lower portion.

BRIEF DESCRIPTION OF THE DRAWINGS

The nature, objects, and advantages of the present invention will become more apparent to those skilled in the art after considering the following detailed description in connection with the accompanying drawings, in which like reference numerals designate like parts throughout, and wherein.

DETAILED DESCRIPTION

Figure 1:
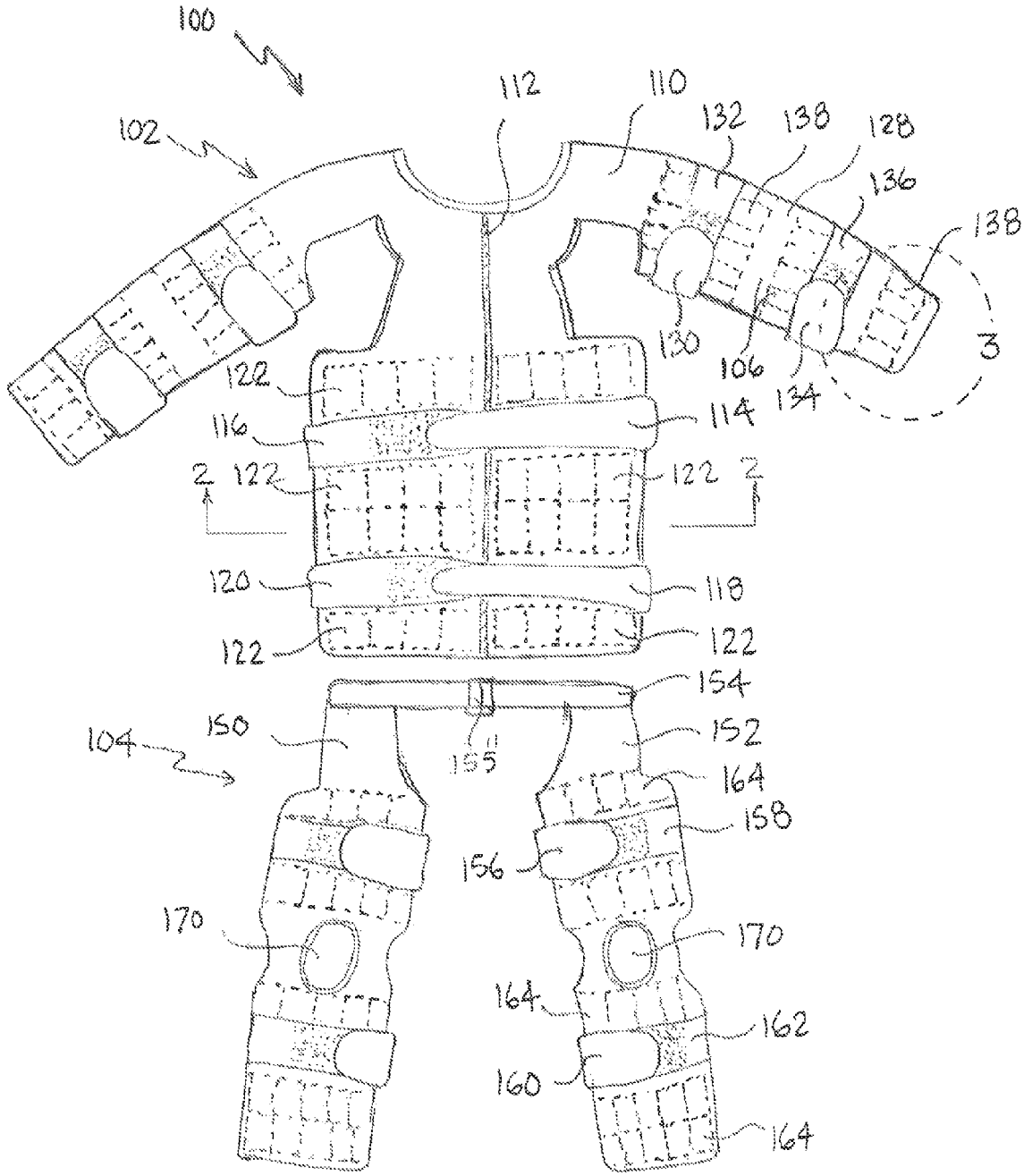
FIG. 1 is a front plan view of the Restriction Compression Weighted Therapy Suit of the present invention showing a shirt portion having arms and equipped with a plurality of weight-receiving pouches, and having compression belts spaced along the arms and torso, and a pant portion having two legs and equipped with a plurality of weight-receiving pouches, and having compression belts spaced along the leg at the thigh and calf.

Referring initially to FIG. 1, a front plan view of the Restriction Compression Weighted Therapy Suit of the present invention is shown and generally designated 100 and includes a shirt portion 102 and a pant portion 104. Shirt portion 102 includes sleeves 106, and is made with a base material 110 and formed with a zipper 112. Base material 110, in a preferred embodiment, is an expandable and breathable material, such as those materials available under the trade names Lycra, Neoprene or Spandex.

Shirt portion 102 is equipped with a number of restrictive straps 114, 116 and 118, 120. As shown, strap portion 114 overlaps corresponding strap portion 116 and with a complementary fastening system, such as Velcro, the straps can be adjusted to provide a specific restrictive and compression force on the body within the shirt portion. For instance, in circumstances where only a small amount of resistive and compressive force is needed, straps 114 and 116 may be pulled together with moderate force. In other circumstances where a larger restrictive and compressive force is needed, straps 114 and 116 may be pulled together with greater force, thereby further restricting and compressing the body within the suit.

The straps discussed herein are, in a preferred embodiment, rigid and non-stretching materials such as Cordura. In other embodiments, the straps used in the present invention may be designed to provide tension forces thereby increasing and providing a steady compressive force despite the movement and/or expansion or contraction of the body within the suit.

The shirt portion 102 of the Restriction Compression Weighted Therapy Suit of the present invention 100 includes a plurality of weight-receiving pouches 122. Each weight-receiving pouch is capable of receiving and retaining therein a weight (discussed in greater detail below). As shown in this figure, the front of shirt portion 102 is substantially covered with weight-receiving pouches 122. It is to be further appreciated that additional pouches 122 may be positioned underneath straps 114, 116 and 118, 120, as well as on the back of the vest 102.

Each sleeve 106 includes a plurality of straps 130, 132 and 134, 136 which provide resistive compressive force to the wearer's arms. Each sleeve is also equipped with a number of weight-receiving pouches 138. Each pouch 138 may be filled with one or more weighted devices.

The pant portion 104 of the Restriction Compression Weighted Therapy Suit of the present invention 100 includes two legs 150 and 152, and are attached together with a cinch belt 155 so that the user can tighten the belt 155 about the waist to avoid any downward slippage due to the weight of the pant portion 104. Each leg 150 and 152 is equipped with a pair of restrictive and compressive straps 156, 158 and 160, 162 to provide restrictive compressive forces to the thighs and calves, respectively. As with the other straps, straps 156, 158 and 160, 162 may be tightened to provide specific restrictive and compressive forces according to the specific user.

Figure 2:
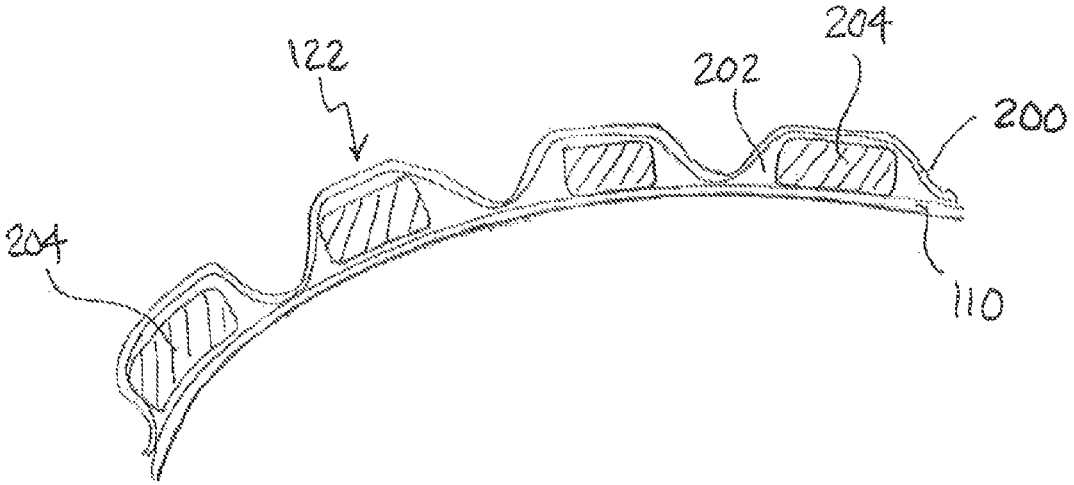
FIG. 2 is a cross-sectional view of the Restriction Compression Weighted Therapy Suit of the present invention of FIG. 1 taken along line 2-2 and showing a number of weight-receiving pouches having weights therein.

Each leg 150 and 152 are formed with a plurality of weight-receiving pouches 164 which function as discussed above. Each pouch 164 may be filled with a weight device having a greater mass than those used in the shirt portion 102, or multiple smaller weights to achieve a more strenuous exercise. A knee cutout 170 may be formed in each leg 152 to facilitate the bending of the leg while wearing the Restriction Compression Weighted Therapy Suit of the present invention;

Referring now to FIG. 2, a cross-sectional view of the shirt portion 102 of the Restriction Compression Weighted Therapy Suit 100 of the present invention of FIG. 1 taken along line 2-2 is shown. Shirt 102 is formed with a base garment 110 and equipped with an external layer 200 that is stitched or otherwise attached to the base periodically to form various pouches 122 having chambers 202. Each chamber 202 is sized to receive a weight device 204. As shown, external layer 200 may be made from a resilient material that allows for stretching to accommodate weight devices having various sizes and shapes.

Figure 3:
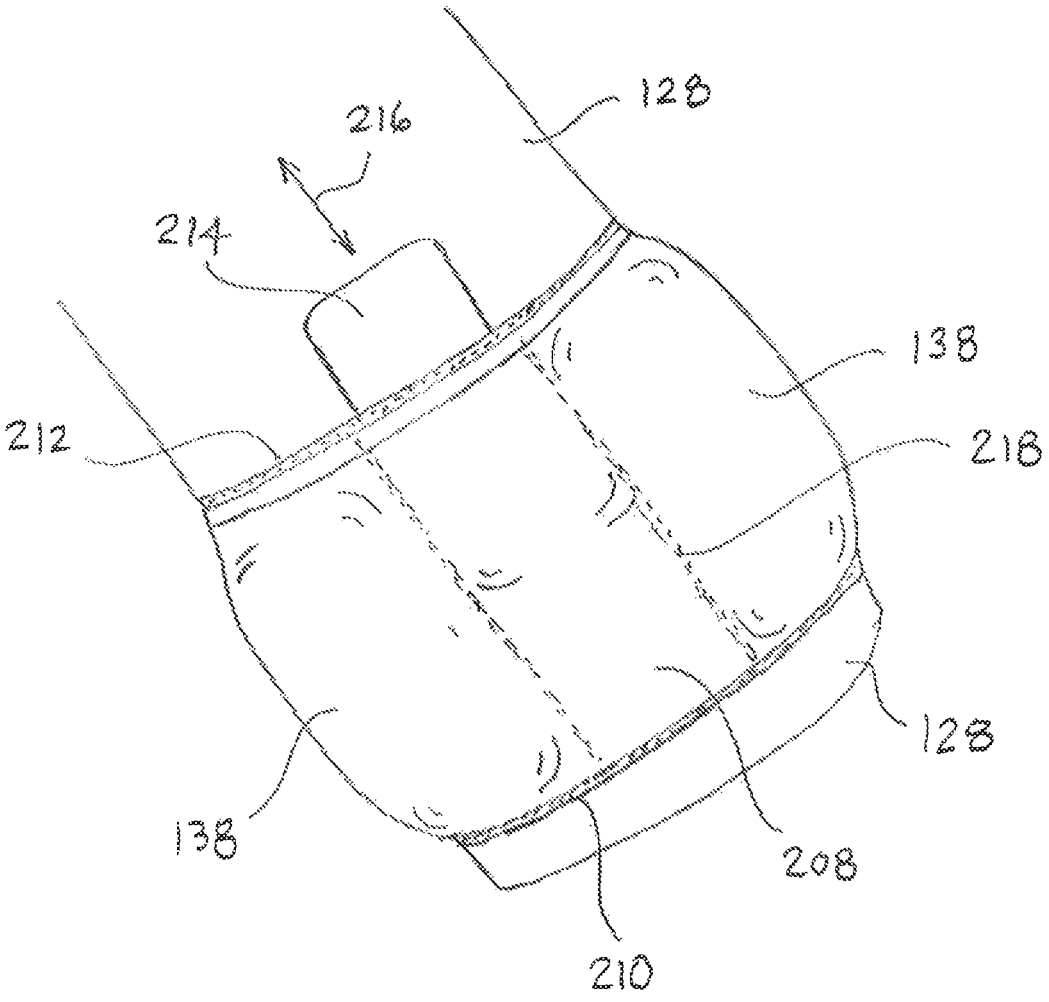
FIG. 3 is an enlarged view of the Restriction Compression Weighted Therapy Suit of the present invention at detail 3-3 of FIG. 1 showing the end of a sleeve having multiple weight-receiving pouches and showing the removable nature of the weights therein.

FIG. 3 is an enlarged view of the Restriction Compression Weighted Therapy Suit 100 of the present invention at detail 3-3 of FIG. 1 and shows the end of a sleeve 106 having multiple weight-receiving pouches 138 and showing the removable nature of the weights therein. Specifically, sleeve material 128 is covered with a pouch-forming layer 208 that is attached to sleeve material 128 at seam 210, such as by stitching or adhesive. Periodical stitching 218 forms a series of pouches 138 to receive a weight device 214. The upper end 212 of the pouch 138 is openable to receive and remove a weight device as shown by directional arrow 216, and thus can be changed and customized for weight needs of different users or different workouts. Pouch 138 may be sealed at opening 212 with an adhesive or Velcro type fastener to facilitate customization.

Figure 4:
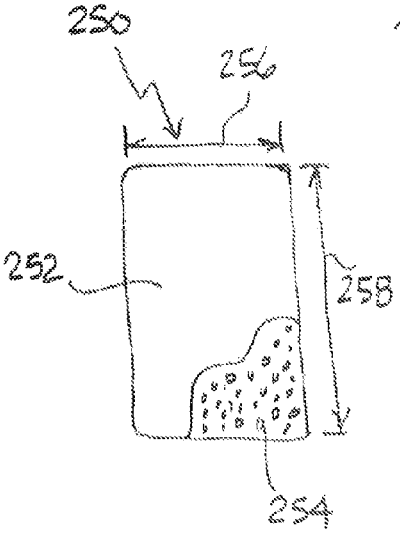
FIG. 4 is a cut-away view of a weight of the Restriction Compression Weighted Therapy Suit of the present invention showing a rectangular shape and containing distributed metallic components to provide increased weight.

FIG. 4 is a cut-away view of a weight 250 of the Restriction Compression Weighted Therapy Suit 100 of the present invention with a generally rectangular shaped body 252 and containing distributed metallic components 254 to provide increased weight. In a preferred embodiment, weight 250 is formed with a width 256 and a height 258 to fit within the pouches of the invention. These sizes may differ according to the desired weight, and the particular pouch size. Also, the size and ratio of metallic components 254 to body material can vary to provide weights having a similar size but differing weights. Also, the body material may, in a preferred embodiment, be a flexible polymer. Alternatively, body material may be rigid and fully encapsulate the metallic components 254.

Figure 5:
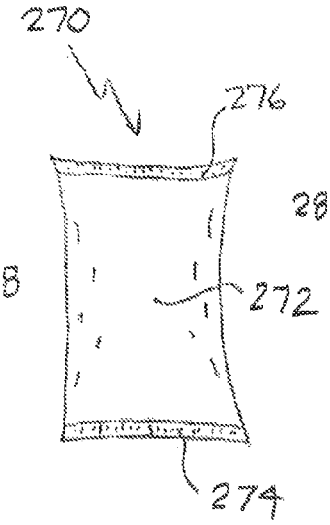
FIG. 5 is a front plan view of an alternative embodiment of the weight of the Restriction Compression Weighted Therapy Suit of the present invention showing a bag having a sealed upper and lower end and filled with weighted substance, such as sand, gravel, steel shot, or lead.

FIG. 5 is a front plan view of an alternative embodiment of the weight 270 of the Restriction Compression Weighted Therapy Suit of the present invention showing a bag 272 having a sealed lower end 274 sealed upper end 276 to retain a weighted substance within the bag 272. In a preferred embodiment, bag 272 may be filled with virtually anything that will add weight to the present invention, including but not limited to sand, water, gravel, bail bearings, steel shot, lead weights, etc.

Figure 6:
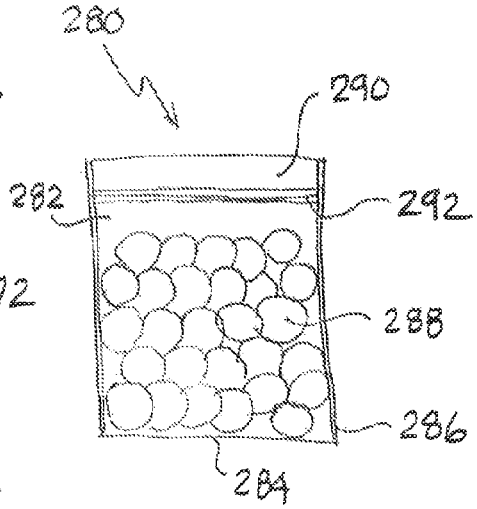
FIG. 6 is a front plan view of another alternative embodiment of the weight of the Restriction Compression Weighted Therapy Suit of the present invention showing a semi transparent bag having a sealed bottom, sides, an open top with a sealable seam to retain a weighted component therein.

FIG. 6 is a front plan view of another alternative embodiment of the weight 280 of the Restriction Compression Weighted Therapy Suit of the present invention showing a bag 282 having a sealed bottom 284, sides 286 and an open top 290 with a sealable seam 292 to retain a weighted component therein. For instance, bag 282 may be made from a semi-transparent material, such as a polymer, and may include a weighted component, such as ball bearings 288.

In use, the Restriction Compression Weighted Therapy Suit 100 of the present invention may be configured with each weight-receiving pouch filled with weights to provide the most rigorous effect to the wearer. Alternatively, only a select group or localized grouping of the weight-receiving pouches may be filled with the weight devices. In this configuration, certain portions of the body may be exercised more than others.

The various weight-receiving pouches have been shown to include a weight device. It is also to be appreciated that these pouches are made from material that stretches, and as a result, may be populated with more than one weight. The weights disclosed herein are not weight specific, and indeed, the weight of a weight device may vary. As a result, larger weights may be used on larger muscle groups, while smaller weights may be used on smaller muscle groups. For instance, the legs may be equipped with much larger weights than the arms thereby maintaining a high degree of effectiveness in training, without the risk of damaging muscles or under-utilizing others.

A result of application of the compressive resistive forces is that the body needs to overcome these forces and as a result expends energy and this will result in weight loss.

Figure 7:
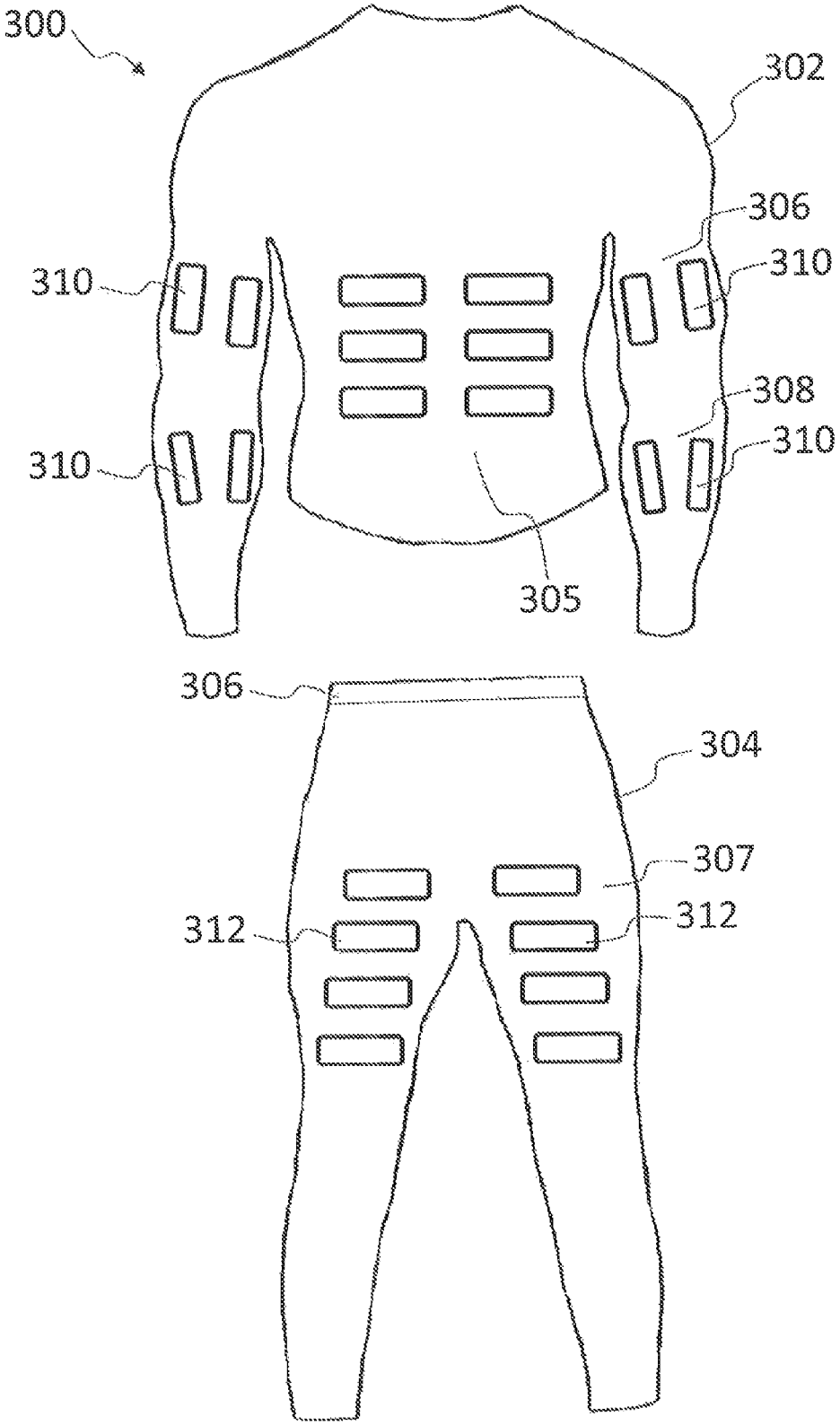
FIG. 7 is a front plan view of an alternative embodiment of the Restriction Compression Weighted Therapy Suit of the present invention showing a one piece top portion and a one piece pants portion. Both portions have closable pockets, strategically located at positions on the outside of the suit that allows for the quick and easy installation and removal of weights. This alternative embodiment is constructed from Spandex, or a similar stretchable and breathable material, so as to make the suit conform and fit snug to the user body. This close fit removes the need for cinches to control the amount of compression applied to the user's body.

FIG. 7 shows a front view of an alternative embodiment of the Restriction Compression Therapy Suit and is generally designated 300. This alternative embodiment uses a form fitting and breathable material, such as Spandex, to create a form-fitting suit 300 that will provide a compressive force to the user's body (not shown). This embodiment consists of two portions, a shirt portion 302 and a pants portion 304. The shirt portion 302 has pockets 310 strategically located in the abdominal area 305, the bicep area 306, and the forearm area 308. The pockets 310 and 312 are designed to be closable to secure the contents inside the pocket during use and storage. The pants portion 304 has pockets 312 located generally in the front area of the thigh 307. These pockets 312 are also closable to keep the contents in place during use and storage. The pants portion 304 also has a waist belt or cinch 306 that allows the user to pull tight to maintain the pants portion 304 in their proper place during use and not allow them to slide down the user's body during use.

This alternative embodiment 300 is designed to be worn underneath a user's clothing to enable the user to benefit from increased resistance during the course of a normal day while engaging in normal activities, such as grocery shopping, work, or house cleaning. The user can add weight to one or more pockets 310 to allow the user to target specific areas of the body that can benefit from the increased and continuous resistance.

Figure 8:
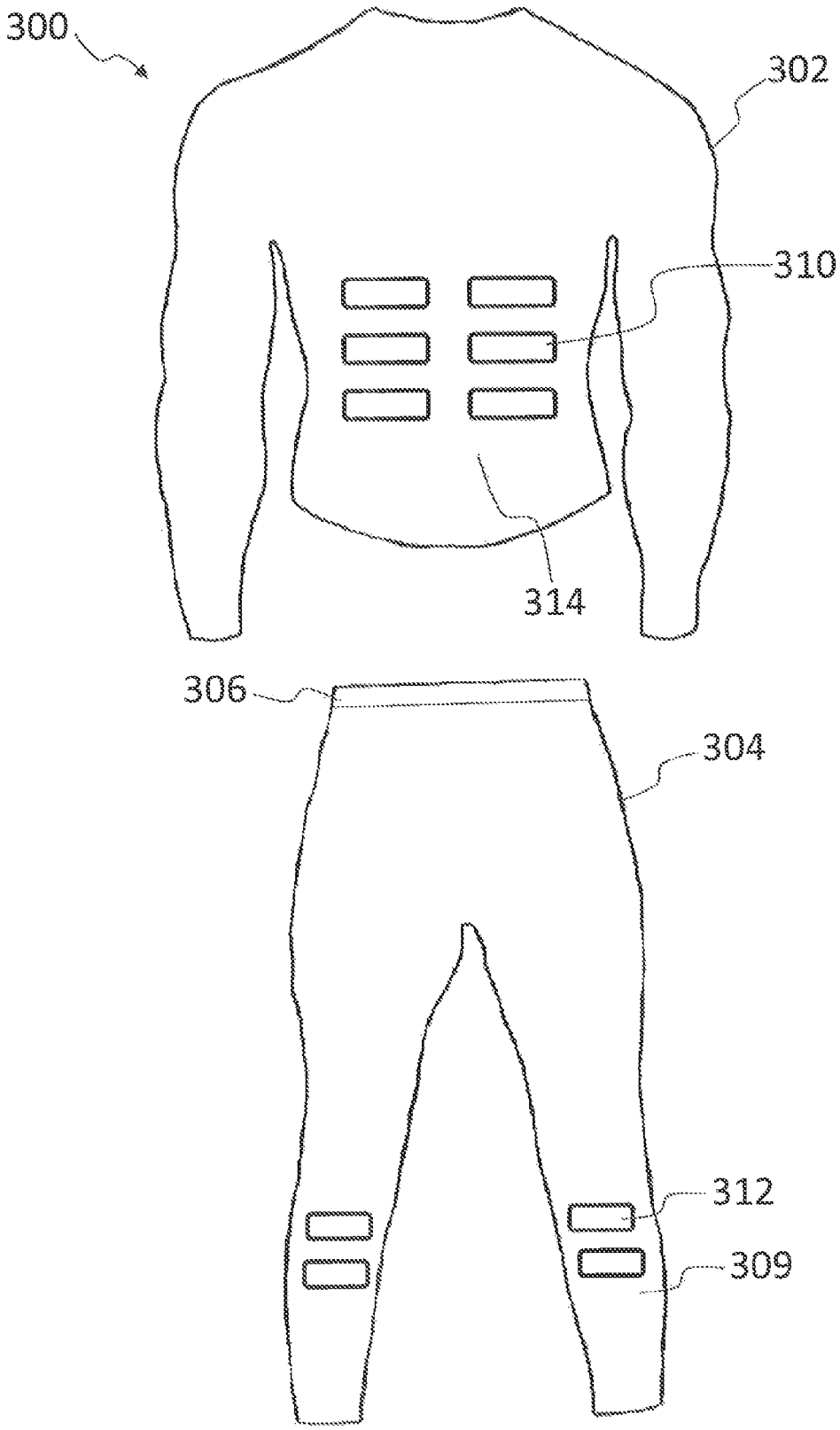
FIG. 8 is a back plan view of an alternative embodiment of the Restriction Compression Weighted Therapy Suit of the present invention showing a one piece shirt portion and a one piece pants portion.

FIG. 8 shows a back view of an alternative embodiment of the Restriction Compression Therapy Suit 300. The shirt portion 302 has one or more pockets located in the mid section of the back 314. The pants portion 304 has one or more pockets 312 located in the calf section 309. These pockets 312 are also closable to prevent the content from coming out during use and storage.

In this embodiment 300, the preferred weights 250 are flat in nature to allow for the user to wear regular clothing over the suit 300 but any type of weight, such as a filled bag 270 or individual balls 288, that fits inside the pocket is fully contemplated.

While there have been shown what are presently considered to be preferred embodiments of the present invention, it will be apparent to those skilled in the art that various changes and modifications can be made herein without departing from the scope and spirit of the invention.

I claim:

1. A Restriction Compression Weighted Therapy Suit comprising:

an shirt portion that covers the torso having pockets located at various positions on the outside of said shirt portion, one or more adjustable compression straps, and constructed from a stretchable and breathable material;

a pants portion having a crotch area, pockets located at various positions on the outside of said pants portion, one or more adjustable compression straps, and constructed from a stretchable and breathable material; and leg extensions having a knee area attached to said pants portion having pockets located at various positions on the outside of the said leg extensions, one or more adjustable compression straps, and constructed from a stretchable and breathable material, wherein the crotch area and the back of the knee area of said pants portion being open and free of material to allow for the free and full range of movement of the legs.

2. The Restriction Compression Weighted Therapy Suit of claim 1, further comprising:

said pockets having a flap that securely closes said pocket to prevent the contents from exiting during use and storage.

3. The Restriction Compression Weighted Therapy Suit of claim 2, further comprising:

said flaps secured closed by way of snaps, buttons, hook and loop style fastener, or zipper.

4. The Restriction Compression Weighted Therapy Suit of claim 1, further comprising:

the straps of said upper portion oriented horizontally and spaced apart vertically such that at least one strap positioned approximately in the chest area, and at least one strap positioned approximately in the abdomen area.

5. The Restriction Compression Weighted Therapy Suit of claim 1, further comprising:

said upper portion, lower portion, sleeves, and leg extensions fabricated from Lycra.

6. The Restriction Compression Weighted Therapy Suit of claim 1, further comprising:

the addition of individual weights into one or more pockets where the number and location of said weights is determined by the resistance needs of the individual user.

7. The Restriction Compression Weighted Therapy Suit of claim 1, further comprising:

the front, back, and underarm region of the shoulder area of said shirt portion being open and free of material to allow for the free and full range of movement of the arm.

8. A Restriction Compression Weighted Therapy Suit comprising:

a shirt portion that covers the torso, including the waist, and arms, including the forearms, having pockets located at various positions on the outside of said shirt portion and constructed from a stretchable and breathable material; and a pants portion having a crotch area, a knee area, and pockets located at various positions on the outside of the said pants portion, one or more adjustable straps, and constructed from a stretchable and breathable material, wherein the crotch area and the knee area of said pants portion being partially open and free of material to allow for the free and full range of movement of the legs.

9. The Restriction Compression Weighted Therapy Suit of claim 8, further comprising:

said shirt portion and pants portion constructed from elastane.

10. The Restriction Compression Weighted Therapy Suit of claim 8, further comprising:

said pockets having a flap that securely closes said pocket to prevent the contents from exiting during use and storage.

11. The Restriction Compression Weighted Therapy Suit of claim 10, further comprising:

said flaps secured closed by way of snaps, buttons, hook and loop style fastener, or zipper.

12. The Restriction Compression Weighted Therapy Suit of claim 8, further comprising:

said pants portion consisting of a belt or cinch located at the top of said pants portion and encircling the waist of the user to maintain said pants portion at its proper position on the user's body during use.

13. The Restriction Compression Weighted Therapy Suit of claim 12, further comprising:

said belt or cinch secured using buttons, snaps, buckle, or hook and loop type fastener.

14. A Restriction Compression Weighted Therapy Suit comprising:

an shirt portion that covers the torso having pockets located at various positions on the outside of said shirt portion, one or more adjustable compression straps, one part of a zipper or snap system located along the edge of the shoulder area of said shirt portion, and constructed from a stretchable and breathable material;

sleeves removably attached to said shirt portion having pockets located at various positions on the outside of said sleeves, one or more adjustable straps, the complementary part of said shirt portion's zipper or snap system, and constructed from a stretchable and breathable material;

a pants portion having a crotch area, pockets located at various positions on the outside of said pants portion, one or more adjustable compression straps, one part of a zipper or snap system located along the bottom edge of said pants portion, and constructed from a stretchable and breathable material; and leg extensions having a knee area removably attached to said pants portion having pockets located at various positions on the outside of the said leg extensions, one or more adjustable compression straps, the complementary part of said pants portion's zipper or snap system, and constructed from a stretchable and breathable material, wherein the crotch area and the back of the knee area of said pants portion being open and free of material to allow for the free and full range of movement of the legs.

15. The Restriction Compression Weighted Therapy Suit of claim 14, further comprising a flap and a means to securely close said flap.

16. The Restriction Compression Weighted Therapy Suit of claim 14, further comprising the straps of said upper portion oriented horizontally and spaced apart vertically such that at least one strap positioned approximately in the chest area, and at least one strap positioned approximately in the abdomen area.

17. The Restriction Compression Weighted Therapy Suit of claim 14, further comprising said upper portion, lower portion, sleeves, and leg extensions fabricated from Lycra.

18. The Restriction Compression Weighted Therapy Suit of claim 14, further comprising the addition of individual weights into one or more pockets where the number and location of said weights is determined by the resistance needs of the individual user.

19. The Restriction Compression Weighted Therapy Suit of claim 14, further comprising the front, back, and underarm region of the shoulder area of said shirt portion being open and free of material to allow for the free and full range of movement of the arm.

* * * * *